US005122003A

United States Patent [19]

Matsumoto et al.

[11] Patent Number: 5,122,003

[45] Date of Patent: Jun. 16, 1992

[54] DOT LINE PRINTER HAVING INK RIBBON GUIDES

[75] Inventors: Yoshikane Matsumoto; Toshio Hiki; Hiroyuki Kurosawa, all of Katsuta, Japan

[73] Assignee: Hitachi Koki Co., Ltd., Tokyo, Japan

[21] Appl. No.: 640,325

[22] Filed: Jan. 11, 1991

[30] Foreign Application Priority Data

Jan. 19, 1990 [JP] Japan ..... 2-011080

[51] Int. Cl.[5] ..... B41J 35/08

[52] U.S. Cl. ..... 400/248; 400/234; 101/93.04

[58] Field of Search ..... 400/194, 195, 196, 196.1, 400/234, 248, 248.1, 642; 101/93.04

[56] References Cited

U.S. PATENT DOCUMENTS

| | | | |
|---|---|---|---|
| 4,157,224 | 6/1979 | Purzycki et al. | 400/234 |
| 4,378,566 | 3/1983 | Tsukamura | 400/234 |
| 4,487,518 | 12/1984 | Enrini | 400/320 |
| 4,650,355 | 3/1987 | Cassiano et al. | 400/248 |
| 4,889,502 | 12/1989 | Matsumoto et al. | 101/93.04 |
| 4,948,278 | 8/1990 | Schiffmacher | 400/248 |

FOREIGN PATENT DOCUMENTS

| | | | |
|---|---|---|---|
| 130866 | 6/1987 | Japan | 400/234 |
| 972418 | 10/1964 | United Kingdom | 400/194 |

*Primary Examiner*—Edgar S. Burr
*Assistant Examiner*—Stephen R. Funk
*Attorney, Agent, or Firm*—Sughrue, Mion, Zinn, Macpeak & Seas

[57] ABSTRACT

A dot line printer having ink ribbon guides for stabilizing running performance of an ink ribbon. A dot line printer includes a hammer bank, a shuttle mechanism, a platen and ink ribbon guides. The hammer bank has print hammers for forming a plurality of dot impressions. The shuttle mechanism has one side positioned adjacent to one end of the hammer bank for reciprocally moving the hammer bank. The platen is adapted for bearing dot impression force, and a part of the ink ribbon is positioned at an ink ribbon path extending along the platen. The ribbon guides have a first guide positioned adjacent to another end of the hammer bank, and a second guide positioned adjacent to another side of the shuttle mechanism. The ink ribbon guides guide travel of the ink ribbon at the ink ribbon path. The ribbon guides further include a third ink ribbon guide positioned between the hammer bank and the shuttle mechanism for further guiding travel of the ink ribbon at the ink ribbon path.

9 Claims, 2 Drawing Sheets

DOT LINE PRINTER HAVING INK RIBBON GUIDES

BACKGROUND OF THE INVENTION

The present invention relates generally to a dot line printer, and more particularly to an ink ribbon guide for enhancing a running stability of an ink ribbon.

Referring to FIG. 1, an arrangement of a conventional dot line printer will be described. The dot line printer includes a hammer mechanism provided with a hammer bank 10. The hammer bank 10 is reciprocally movable along a line extending in a direction transverse with respect to a print paper. The hammer bank 10 accommodates a plurality of print hammers 11 which perform printing on the print paper on a dot line basis as the hammer bank 10 reciprocates back and forth.

There have been several mechanism proposed for reciprocally moving the hammer bank 10. A typical mechanism uses a cam or a ball screw with which a rotational motion produced by a motor is translated into a reciprocal linear motion. Another mechanism uses a voice coil motor or a linear motor with which the hammer bank 10 is directly moved reciprocally. Of those, the cam mechanism and the drive arrangement using the voice coil motor are suitable for a higher repetitive frequency of the reciprocal motion. On the other hand, the mechanisms using the ball screw and the linear motor is suitable for a lower repetitive frequency of the reciprocal motion. The cam mechanism or the voice coil motor is typically provided in one side portion of a hammer bank 10 in terms of facility, reliability and constraint in joining the hammer bank 10 and a hammer bank shuttle mechanism 20. (The shuttle mechanism 20 is known as a mechanism for reciprocating the hammer bank 10.) An arrangement of the dot line printer using the cam mechanism as the shuttling means, a printing scheme, and potential problems involved will be described.

The shuttle mechanism 20 is disposed in one side of the hammer bank 10 (right side in FIG. 1), and is coupled to the hammer bank 10 with a bolt 21. This arrangement is disclosed in U.S. Pat. No. 4,889,052. The shuttle mechanism 20 includes a cam 22 rotatable by a shuttle motor (not shown), a pair of cam followers 23 provided in rolling contact with the cam 22, a shiftable plate 24 and a shiftable shaft 25. Upon rotation of the cam 22, the shiftable plate 24 and the shiftable shaft 25 are reciprocally movable in an axial direction of the shaft 25 through the cam followers 23. For supporting and guiding the shiftable shaft 25, linear bearings 26 are provided. The shiftable shaft 25 extends through the bearing 26 and is coupled to the hammer bank 10 by the bolt 21.

A bank shaft 27 is connected to another side of the hammer bank 10 (left side in FIG. 1), and another linear bearing 28 is provided for supporting the bank shaft 27, to thereby support the reciprocal motion of the hammer bank 10. Print hammers 11 are arranged in spaced apart relation to one another in the direction in which the hammer bank 10 moves. Although not shown, a print hammer driver is provided in association with each print hammer 11, which includes a permanent magnet, a yoke and a release coil. The hammer 11 is attracted to the face of the yoke pole by the permanent magnet and is released therefrom in response to the energization of the release coil, whereby the dot pin strikes the paper through an ink ribbon 40 to thus make an impression of a dot on a paper 30.

A platen 31 is provided on a sheet feed mechanism which includes a paper feed motor (not shown). The sheet feed mechanism is adapted to feed a print paper in a direction perpendicular to a reciprocating direction of the hammer bank 10. The platen 31 is positioned slightly spaced away from the hammer bank 10 for bearing dot impression force applied from the print hammers 11 and for guiding travel of the paper 30. Both end portions of the platen 31 are rotatably supported by hearings 32 coupled to a sheet feed frame 33 of the sheet feed mechanism. Incidentally, the sheet feed mechanism also includes a tractor (not shown) positioned above the platen 31. The print paper is engageable with the tractor in a known manner.

Between the hammer bank 10 and the platen 31, the ink ribbon 40 is positioned. Further, a pair of ribbon guides 41 and 42 are provided for defining an ink ribbon path along which the ink ribbon 40 travels in a direction indicated by an arrow at a predetermined speed. One of the ribbon guides 41 is positioned at a left side of the hammer bank 10, while the other ribbon guide 42 is positioned at a right side of the shuttle mechanism 20. The ink ribbon 40 is of an elongated tape like configuration and has a width ranging from 0.5 to 1.5 inches and a length ranging from 50 to 100 m. The ink ribbon 40 is formed of a nylon impregnated with an ink.

An ink ribbon cassette 45 is detachably provided at a given location for accommodating therein the ink ribbon 40. The cassette 45 is formed with an ink ribbon outlet at which a ribbon brake means 46 is provided so as to impart a proper tension to the ink ribbon 40. Further, the cassette 45 is formed with an ink ribbon inlet portion at which a pair of drive rollers 43 are provided to drivingly feed the ink ribbon 40. Furthermore, an ink ribbon sensor 44 is provided for detecting malfunction in running the ink ribbon 40. The ink ribbon sensor 44 also serves as a guide means for guiding travel of the ink ribbon 40. With the structure, the ink ribbon 40 accommodated in the cassette 45 is discharged through the ribbon brake means 46, and runs in parallel with the platen 31 by the guidance of the ink ribbon guides 41 and 42, and is pulled into the cassette 45 by the drive rollers 43 through the ink ribbon sensor 44. When the ink ribbon 40 is at a position between the ink ribbon guides 41 and 42, the ink ribbon 40 is apparently positioned between the hammer bank 10 and the platen 31.

With the above described structure, when the shuttle motor is energized, the hammer bank 10 shuttles back and forth along a print line. During the movement of the hammer bank 10 in the right-hand direction, the print hammers 11 are selectively fired, thereby making dot impressions on the paper 30. The hammer bank 10 reaches the rightmost position and turns around thereat. At this time, the paper feed motor (not shown) is energized to advance the paper 30. The hammer bank 10 then moves leftwardly and the print hammers 11 makes another dot impressions on the paper 30. In this manner, one line made up of plural dot lines is printed by repeatedly carrying out such alternate print and paper feed cycles.

In the case of the high speed dot impression process, printing is carried out at a speed of 300 lines per minute with 100 dots per character for 136 columnar characters per line. Therefore, the number of printed dots can be as many as 68,000 dots per second ($300 \times 100 \times 136/60$). Instantaneously, there may be a case where the number of the dots is not less than 100,000 dots per second. Further, various kinds of printing papers 30 may be loaded on the printer. Among these, relatively thick paper such as 5-fold to 8-fold carbonless duplicating papers or no carbon papers such as those used for multi-slips may also be loaded. In this case, edge portions of the multi-slips are pasted up or are joined together by a stapler. Therefore, locally thick portion may exist in the paper to be loaded in the dot printer. Furthermore, the paper 30 is fed at the lowest velocity of about 1 inch per second in the case where printing is done on a line by line basis. On the other hand, the paper feed velocity may be increased up to 15 to 25 inches per second in the case where printing jumps every several lines or requires a blank portion.

SUMMARY OF THE INVENTION

Inventors of the present invention have found the drawbacks in printing quality. That is, if the high speed dot printing is carried out at high speed paper feeding with the employment of thick paper, the ink ribbon 40 running between the hammer bank 10 and the platen 31 largely undergoes offsetting force with respect to paper feed direction as well as the reciprocating direction of the hammer bank 10 (line direction). That is, the ink ribbon 40 may be deviated from its proper location. The above described ribbon guide 41 positioned at the left side of the hammer bank 10 and the ribbon guide 42 positioned at right side of the shuttle mechanism 20 may prevent the ink ribbon 40 from its deviation with respect to the paper feed direction from its proper ribbon path. If a small distance between the two guides 41 and 42 can be provided, such deviation amount can be reduced. However, since the shuttle mechanism 20 is located at the right side of the hammer bank 10, the right side ink ribbon guide 42 must be geometrically located at a position spaced away from the hammer bank 10. Therefore, the distance between the two guides 41 and 42 cannot be reduced to a small level.

Further, the running direction of the ink ribbon 40 is substantially the same as the reciprocating direction of the hammer bank 10. Therefore, the ink ribbon 40 is subjected to deceleration or acceleration force in the running direction thereof due to dot impression frequency. As a result, the tension of the ink ribbon 40 may be varied, and the ink ribbon 40 may be slackened in front of the hammer bank 10 or overtension may be applied to the ribbon 40. Consequently, the relative speed between the ink ribbon 40 and the hammer bank 10 may occasionally be zero, and the print hammers 11 may repeatedly impact the identical portions of the ink ribbon 40, to thereby greatly reduce ink transfer efficiency onto the paper. In other words, uniform output printing image density may not be obtainable.

If the ink ribbon 40 is slackened, the ribbon 40 may be deviated to the paper feed direction, and the ink ribbon guides 41 and 42 may not perform their inherent ribbon guide performance. As a result, the ink ribbon 40 does not smoothly run in its running direction indicated by the arrow in FIG. 1. If the ink ribbon 40 is largely deviated from the ink ribbon path to the paper feed direction, the ink ribbon 40 may be displaced from the hammer bank 10 and, the print hammers may directly impact the paper 30. If such misalignment between the hammer bank and the ink ribbon 40 occurs for a relatively prolonged duration (such as several seconds), the ink ribbon 40 may be enrolled or involved into the drive roller 43 to damage ambient mechanical components, and the ink ribbon 40 may be entangled with the print hammers 11, and the ribbon 40 and the hammers 11 may be destroyed.

In view of the above, the running stability of the ink ribbon 40 is extremely important in the dot printer, particularly, in the high speed dot printing operation. Therefore, it is an object of the present invention to overcome the above described drawbacks and disadvantages and to provide a dot line printer provided with an improved ink ribbon guide for enhancing a running stability of an ink ribbon, to thus provide a reliability of the dot line printer.

Another object of the invention is to provide such dot line printer in which uniform dot image density is obtainable without any occurrence in omission of characters or words, and without any damage to the ink ribbon, print hammer and a mechanism associated with the ink ribbon such as drive roller and ink ribbon cassette.

These and other objects of the present invention will be attained by providing a dot line printer using an ink ribbon comprising: a hammer bank having print hammers for forming a plurality of dot impression, the hammer bank having one and another ends, a shuttle mechanism having one side positioned adjacent to the one end of the hammer bank for reciprocally moving the hammer bank, the shuttle mechanism having another side, a platen for bearing dot impression force, a part of the ink ribbon being positioned at an ink ribbon path extending along a space between the hammer bank and the platen, a pair of ink ribbon guides comprising a first guide positioned adjacent to the other end of the hammer bank, and a second guide positioned adjacent to the other side of the shuttle mechanism, the ink ribbon guides guiding travel of the ink ribbon at the ink ribbon path, and a third ink ribbon guide positioned between the hammer bank and the shuttle mechanism for further guiding travel of the ink ribbon at the ink ribbon path. However, if the expression "between A and B" is construed as not including "A" and "B" in view of location, the position of the third ink ribbon guide should be described as being positioned between the one end of the hammer bank and the second ink ribbon guide and adjacent to the one end of the hammer bank.

DETAILED DESCRIPTION OF THE PREFERRED EMBODIMENTS

Figure 1:
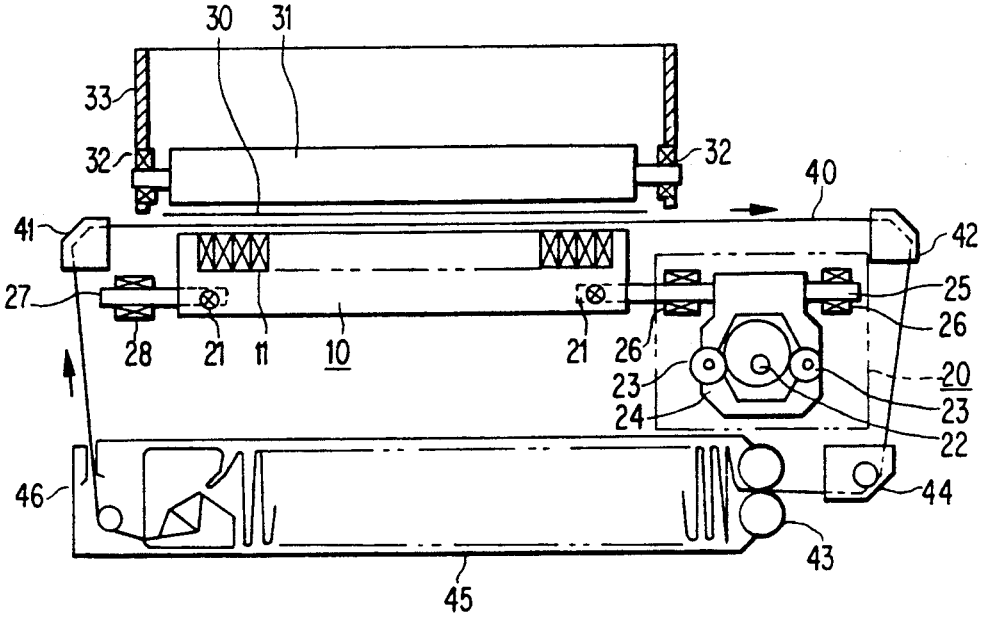
FIG. 1 PRIOR ART
FIG. 1 is a schematic plan view showing an essential printing mechanism according to a conventional dot line printer.

A dot line printer according to a first embodiment of this invention will be described with reference to FIGS. 2 through 5, wherein like parts and components are designated by the same reference numerals and characters as those shown in FIG. 1, and in this connection duplicating description will be avoided.

Figure 2:
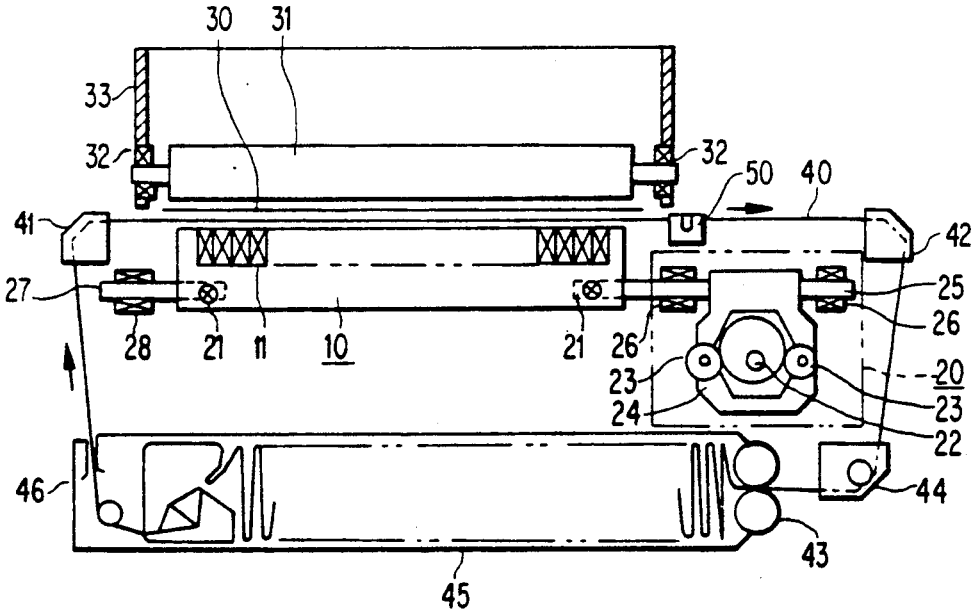
FIG. 2 is a schematic plan view showing an essential printing mechanism of a dot line printer according to one embodiment of the present invention.
Figure 5:
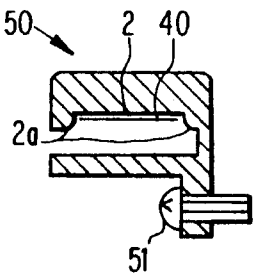
FIG. 5 is a cross-sectional view taken along the line V—V of FIG. 3.
Figure 4:
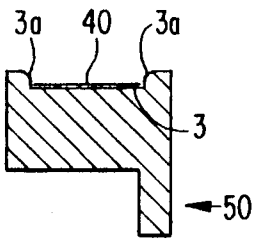
FIG. 4 is a cross-sectional view taken along the line IV—IV of FIG. 3.
Figure 3:
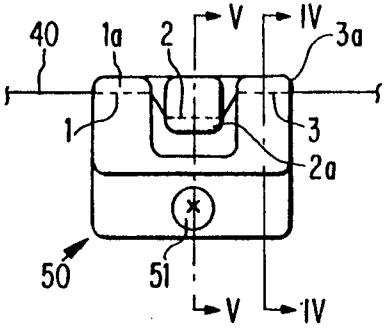
FIG. 3 is an enlarged side view showing a ribbon guide positioned at a right side of a hammer bank according to one embodiment of this invention.

In the first embodiment, in addition to first and second ink ribbon guides 41 and 42, a third ribbon guide 50 is provided between a reciprocable hammer bank 10 and a shuttle mechanism 20 as best shown in FIG. 2. The third ribbon guide 50 is fixedly secured to a base member (not shown) by means of a screw 51. In order to provide ink ribbon retaining force so as to avoid deviation of an ink ribbon 40 as well as to avoid excessive acceleration or deceleration thereof, the third ribbon guide 50 has an improved configuration as shown in FIGS. 3 through 5. First, in the first embodiment, at least two sliding surface portions are provided along which the ink ribbon 40 slidingly runs. In the illustrated embodiment, three sliding surface portions 1, 2, and 3 are provided in conformance with an ink ribbon path. That is, the three sliding surface portions 1, 2 and 3 are not deviated with one another with respect to paper feed direction, while these are deviated with one another with respect to a widthwise direction (gap distant direction) between a platen 31 and a hammer bank 10. Accordingly, the ink ribbon 40 is bent three times by the third ink ribbon guide 50 with respect to the reciprocating direction of the hammer bank 10.

More specifically, the first sliding surface portion 1 is positioned in alignment with an ink ribbon path defined between the first and the second ink ribbon guides 41 and 42, and is adapted to contact with one side of the ink ribbon 40. The second sliding surface portion 2 is positioned offset from the ink ribbon path and is adapted to contact with an opposite side of the ink ribbon 40. The third sliding surface portion 3 is positioned in alignment with the first sliding surface 1 and is adapted to contact with the one side of the ribbon 40 to thereby restore original position of the ink ribbon which has been deviated by the second sliding surface portion 2. Further, flanges 1*a*,1*a*, 2*a*, 2*a*, and 3*a*,3*a* extend from the sliding surface portions 1, 2 and 3 so as to support side edge lines of the ink ribbon 40.

Because of this arrangement, since the third ink guide 50 is provided at a position adjacent to one end of the hammer bank 10, running stability of the ink ribbon 40 is greatly enhanced in association with the first ink ribbon guide 41 positioned at another end of the hammer bank 10. Further, the ink ribbon 40 can run along and around the sliding surface portions 1, 2 and 3 since the positions of the first through third sliding surface portions 1,2 and 3 are different from each other. Therefore, the ink ribbon 40 can be held at a constant horizontal position, and deviation of the ink ribbon 40 with respect to the paper feed direction is greatly avoidable.

Figure 6:
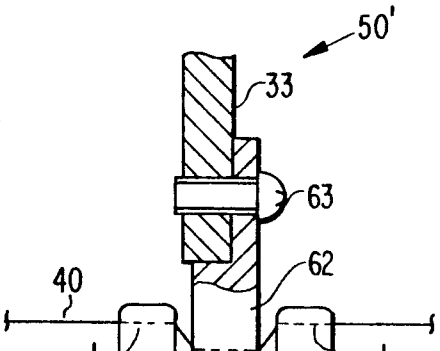
FIG. 6 is an enlarged side view showing a ribbon guide according to a second embodiment of this invention.

A dot line printer according to a second embodiment will be described with reference to FIG. 6. In the first embodiment, it would be rather difficult to install the ink ribbon to its ink ribbon path, and to remove the ribbon from the path during replacement. That is, the second sliding surface portion may degrade assembly and disassembly of the ink ribbon. With the above in mind, according to the second embodiment, a third ribbon guide 50' is generally divided into two section 60 and 62. The first section 60 having corresponding first and third sliding surface portions 1' and 3' is fixedly secured to a frame which supports the hammer bank 10 and a shuttle mechanism 20. On the other hand, the second section 62 which includes a corresponding second sliding surface portion 2' is secured, by a screw 63, to a paper feed mechanism's frame 33 which supports a platen 31. The platen 31 is movable by the movement of the paper feed frame 33, the latter movement being provided by using, for example, an eccentric cam. Therefore, if the platen 31 is moved rearwardly, the second section 62 is simultaneously moved rearwardly, In other words, the second section 62 is movable in response to the movement of the platen 31.

With this structure, if the ink ribbon 40 is to be assembled into or disassembled from the printing mechanism, the platen 31 is moved away from the hammer bank 10 (for providing "platen open" state) to provide a sufficient working space. Accordingly, the second sliding surface portion 2' is moved farther from the first and the third sliding surface portions 1' and 3', and the ink ribbon 40 can be positioned at given sliding positions. After the "platen open" work, the ink ribbon 40 is brought to sliding engagement with the second sliding surface portion 2'.

Figure 7:
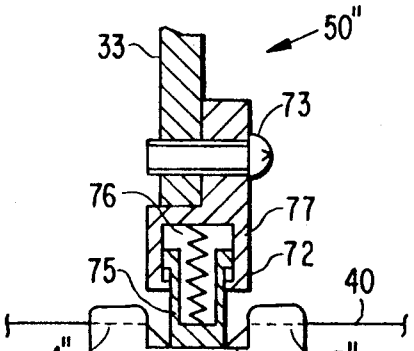
FIG. 7 is an enlarged cross-sectional view showing a ribbon guide according to a third embodiment of this invention.

A dot line printer according to a third embodiment will be described with reference to FIG. 7. In the third embodiment, the third ribbon guide 50'' has first and second sections 70 and 72 similar to the second embodiment. However, the second section 72 including a second sliding portion 2'' includes a movable guide 75, a brake frame 77 and a biasing member 76. The brake frame 77 is fixedly secured to the frame 33 by a screw 73 and is adapted to slidably receive the movable guide 75 for guiding the sliding motion of the movable guide 75. The movable guide 75 has a cup shaped configuration to receive the biasing member 76 in its hollow space. The biasing member 76 is provided by a coil spring which urges the movable guide 75 toward the first section 70.

If the hammer bank 10 is moved in a direction, for example, leftwardly in FIG. 2, the ink ribbon 40 may also be urged in the direction under tension. However, according to the third embodiment, the second sliding portion 2'' sufficiently urges the ink ribbon 40 by the biasing force from the movable guide 75, to thus sustain the leftward urging force applied to the ink ribbon 40 and provided by the hammer bank. Consequently, ink ribbon slack at the ribbon portion confronting the hammer bank can be reduced, and any elongation of the ribbon portion between the hammer bank 10 and the drive roller 43 can also be reduced.

As described above, according to the dot line printer of the present invention, the third ink ribbon guide is provided at a position between the hammer bank and the shuttle mechanism, and therefore, running stability of the ink ribbon can be enhanced, and avoidable are degradation of printing quality, omission of characters or words, breakage of the ink ribbon, and breakdown of the print hammer and the ink ribbon components, because of the elimination of disarray in ink ribbon running. Further, in the second and third embodiments of the present invention, the third ink ribbon guide is divided into two segments, and one of the segments having a sliding surface with which the ink ribbon slidingly contacts is secured to the frame of the paper feed mechanism. Therefore, the ink ribbon can be smoothly loaded or detached on or from the predetermined position of the print mechanism. Furthermore, in the third embodiment, the brake mechanism is incorporated in the third ink ribbon guide. Therefore, running stability of the ink ribbon can further be improved.

While the invention has been described in detail and with reference to specific embodiments thereof, it would be apparent to those skilled in the art that various changes and modifications may be made therein without departing from the spirit and scope of the invention.

What is claimed is:

1. A dot line printer using an ink ribbon comprising:

a hammer bank having print hammers for forming a plurality of dot impressions, the hammer bank having first and second ends;

a shuttle mechanism having a first side positioned adjacent to the second end of the hammer bank for reciprocally moving the hammer bank;

a platen for bearing dot impression force, a part of the ink ribbon being positioned at an ink ribbon path extending through a space between the hammer bank and the platen;

a pair of ink ribbon guides comprising a first guide positioned adjacent to the first end of the hammer bank, and a second guide positioned adjacent to a second side of the shuttle mechanism, the ink ribbon guides guiding travel of the ink ribbon at the ink ribbon path;

a third ink ribbon guide positioned between the hammer bank and the shuttle mechanism for further guiding travel of the ink ribbon at the ink ribbon path, wherein the third ink ribbon guide comprises at least two sliding surface portions in sliding contact with the ink ribbon, the at least two sliding surface portions defining a crooked ribbon path; and a first frame portion for supporting the hammer bank and the shuttle mechanism, and a second frame portion for supporting the platen, and wherein the third ink guide comprises a first section having at least one of the sliding surface portions, and a second section provided separate from the first section and having the remainder of said at least two sliding surface portions, the first section being supported on the first frame portion, and the section section being supported on the second frame portion.

2. The dot line printer as claimed in claim 1, wherein the sliding surface portions comprises a first sliding surface portion positioned in alignment with the ink ribbon path, a second sliding surface portion positioned offset from the ink ribbon path, and a third sliding surface portion positioned in alignment with the first sliding surface portion, the second sliding surface portion being positioned between the first and the third sliding surface portions whereby the crooked ink ribbon path is provided.

3. The dot line printer as claimed in claim 2, wherein the first section includes the first and the third sliding surface portions, and the second section includes the second sliding surface portion.

4. The dot line printer as claimed in claim 3, wherein the ink ribbon has a front surface and a rear surface, the first and the third sliding surface portions being positioned to contact with the front surface of the ink ribbon, and the second sliding surface portion being positioned to contact with the rear surface of the ink ribbon.

5. The dot line printer as claimed in claim 4, wherein the third ink ribbon guide further comprises urging means for urging the ink ribbon to a direction offset from the ink ribbon path, the urging means being provided at the second sliding surface portion.

6. The dot line printer as claimed in claim 5, wherein the urging means comprises a brake frame fixedly secured to the second frame portion;

a movable guide disposed slidable with respect to the brake frame, the movable guide having one end provided with the second sliding surface portion; and biasing means positioned between the brake frame and the movable guide for urging the movable guide toward the first section.

7. The dot line printer as claimed in claim 1, wherein the third ink ribbon guide further comprises urging means for urging the ink ribbon to a direction offset from the ink ribbon path.

8. The dot line printer as claimed in claim 1, further comprising a sheet feed mechanism for feeding a paper in a direction perpendicular to the reciprocating direction of the hammer bank, and wherein the frame is one of the components of the sheet feed mechanism.

9. A dot line printer using an ink ribbon comprising:

a hammer bank having print hammers for forming a plurality of dot impressions, the hammer bank having first and second ends;

a shuttle mechanism having a first side positioned adjacent to the second end of the hammer bank for reciprocally moving the hammer bank;

a platen for bearing dot impression force, a part of the ink ribbon being positioned at an ink ribbon path extending through a space between the hammer bank and the platen;

a pair of ink ribbon guides comprising a first guide positioned adjacent to the first end of the hammer bank, and a second guide positioned adjacent to a second side of the shuttle mechanism, the ink ribbon guides guiding travel of the ink ribbon at the ink ribbon path;

a third ink ribbon guide positioned between the hammer bank and the shuttle mechanism for further guiding travel of the ink ribbon at the ink ribbon path, wherein the third ink ribbon guide comprises at least two sliding surface portions in sliding contact with the ink ribbon, the at least two sliding surface portions defining a crooked ribbon path; and a sheet feed mechanism, wherein the third ink guide comprises a first section having at least one of the sliding surface portions, and a second section having the remainder of said at least two sliding surface portions and provided separate from the first section, the second section being supported on the sheet feed mechanism, and the platen being supported on the sheet feed mechanism, wherein the second section is coupled with the platen and moves in synchrony therewith.

* * * * *